United States Patent [19]

Maejima et al.

[11] Patent Number: 4,871,325

[45] Date of Patent: Oct. 3, 1989

[54] CONNECTOR

[75] Inventors: Toshiro Maejima; Shigemitsu Inaba, both of Shizuoka, Japan

[73] Assignee: Yazaki Corportion, Japan

[21] Appl. No.: 251,448

[22] Filed: Sep. 30, 1988

[30] Foreign Application Priority Data

Sep. 30, 1987 [JP] Japan ..... 62-148273[U]

[51] Int. Cl.[4] ..... H01R 13/627

[52] U.S. Cl. ..... 439/353; 439/372; 439/489

[58] Field of Search ..... 439/366, 367, 368, 369, 439/370, 371, 372, 310, 345, 350, 353, 357, 358, 144, 586, 748, 489; 285/320

[56] References Cited

U.S. PATENT DOCUMENTS 1,899,360 2/1933 Roudebush et al. ..... 439/372 X
3,178,674 4/1965 Scheller ..... 439/748
3,239,791 3/1966 Fyrk ..... 439/144
4,674,814 6/1987 Hoshino et al. ..... 439/586
4,714,433 12/1987 Rider ..... 439/310

FOREIGN PATENT DOCUMENTS 62-10885 1/1987 Japan ..... 439/586

*Primary Examiner*—Neil Abrams
*Assistant Examiner*—Khiem Nguyen
*Attorney, Agent, or Firm*—Wigman & Cohen

[57] ABSTRACT

To allow a worker to check whether two first and second matable connector housings are securely engaged with each other and further to firmly lock the two connector housings, the first connector housing is provided with a pivotal locking member pivoted when the two connector housings are engaged with each other, and further locked to an arm locking bridge portion provided at the second connector housing when further pivoted by the worker for connector locking.

3 Claims, 2 Drawing Sheets

CONNECTOR

BACKGROUND OF THE INVENTION

1. Field of the Invention

The present invention relates to a connector for connecting at least two wires and more specifically to a connector provided with connector housing locking function.

2. Description of the Prior Art

To connect plural electronic appliances mounted on an automotive vehicle, for instance, a plurality of connectors are used. Each connector is composed of a male connector housing in which a single or plural wire connecting elements are housed and a female connector housing in which a single or plural wire connecting elements are housed.

An example of these prior-art connectors is disclosed in Japanese Published Unexamined (Kokai) Patent Application No. 62-10885, for instance. In this prior-art connector, a female connector housing is provided with a pivotable locking member supported by hinges and a male connector housing is formed with a cutout. Therefore, after the two male and female connector housings are engaged with each other, the pivotable locking member is inserted into the cutout for locking operation.

In the prior-art connector, however, even after the connector housing has been engaged with each other, since the locking member is not moved, there exists a problem in that the assembly worker tends to forget to lock the connector housing by use of the locking member. In case the connector housings are not firmly locked by the locking member, the engagement of two male and female housings becomes unstable, in particular when cracks are produced in the housings due to the elapse of time.

SUMMARY OF THE INVENTION

With these problems in mind, therefore, it is the primary object of the present invention to provide a connector which permits a reliable locking engagement between two male and female connector housings by allowing the worker to visually chek whether the two connector housings have firmly been engaged and further locked.

To achieve the above-mentioned object, a connector according to the present invention comprises (a) a first connector housing for housing at least one first wire connecting terminal, said first connector housing being formed with a deformable engage block portion and an arm locking portion; and (b) a second connector housing for housing at least one second wire connecting terminal matable with the first wiring connecting terminal when said two first and second connector housings are connected to each other, said second connector housing being formed with an engage projection portion engaged with the deformable engage block portion when said first and second connector housings are connected to each other and a pivotable locking arm member pivoted when said first connector housing is engaged with said second connector housing and locked to the arm locking portion of said first connector housing when said pivotable locking arm member is further pivoted for connector locking operation.

In the connector according to the present invention, when the two connector housings are engaged with each other, since the pivotable locking arm member is moved, the worker can check whether the two housing have firmly been engaged with each other. In addition, the pivotal motion of the pivotable locking arm member urges the worker to further move the locking arm member into lock condition. Therefore, the two connector housings can firmly be locked. In other words, the worker can know whether the two connector housings have been engaged or locked to each other on the basis of the pivotal motion of the locking arm member.

BRIEF DESCRIPTION OF THE DRAWINGS

The features and advantages of the connector according to the present invention over the prior-art connector will be more clearly appreciated from the following description of a preferred embodiment of the invention taken in conjunction with the accompanying drawings in which like reference numerals designate the same or similar elements throughout the figures thereof and in which.

DETAILED DESCRIPTION OF THE PREFERRED EMBODIMENTS

Figure 1:
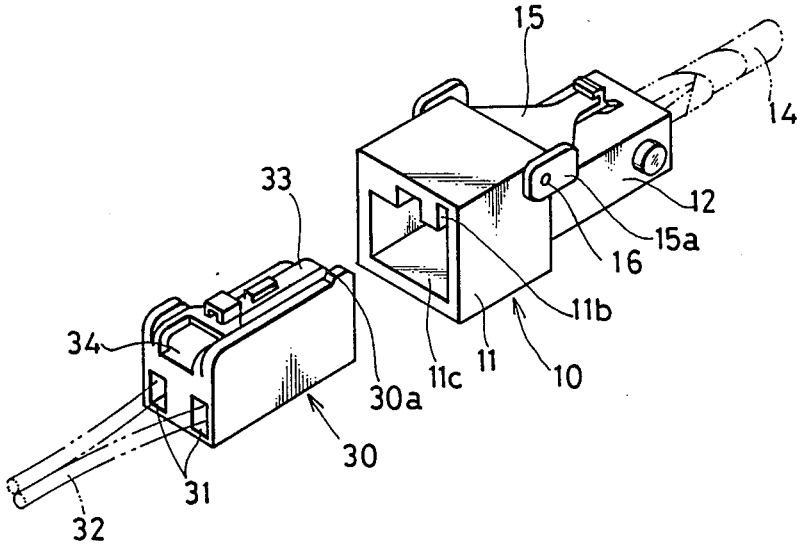
FIG. 1 is a perspective view showing an embodiment of a connector according to the present invention.

In FIG. 1, a connector of the present invention is roughly composed of a female connector housing 10 and a male connector housing 30. The female connector housing 10 is formed with a first housing 11 into which a male housing 30 is inserted for engagement between the two housings 10 and 30, a second housing 12 into which two wire connecting terminals fixed to wires of a cable 14 are inserted, and a pivotable locking arm 15 having two leg portions **15*a* pivotably supported by two pivotal axles 16 fixed to the first housing 11. Further, the first housing 11 is formed with a large cavity 11*c* for housing the male housing 30 and a guide groove 11*b* for guiding the male housing 30 into the female housing 10**.

Figure 2:
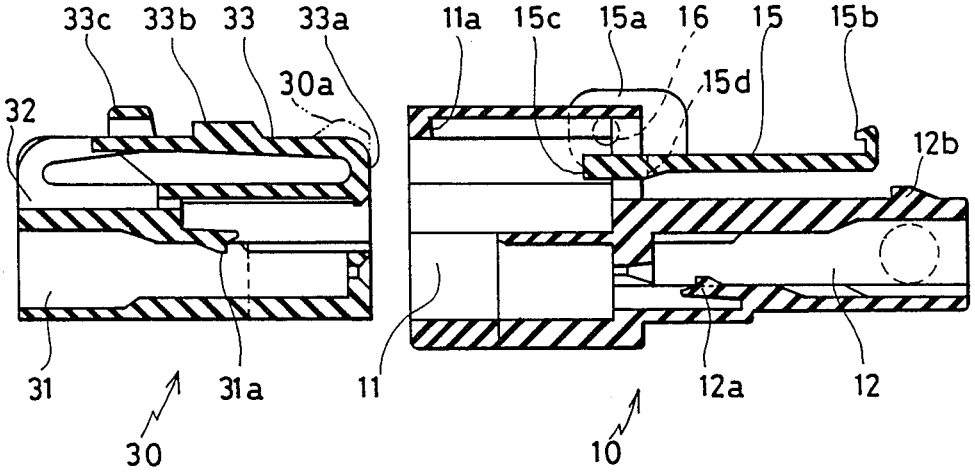
FIG. 2 is a cross-sectional views showing a pair of male and female connector housings of the connector according to the present invention.

Further, the pivotable locking arm 15 is formed with two slits **15*d* into which two wall portions of the female connector housing 10 are inserted when the locking arm 15 is pivoted open as shown in FIG. 2**.

The male housing 30 is formed with two lower housings 31 into each of which a wire connecting terminal fixed to a wire of a cable 32 is inserted, an upper housing 34 into which a wire connecting terminal (not shown in FIG. 1 but shown in FIG. 3) is inserted, and an engage portion 33 of fixed beam type engageable with the female housing 10. Further, a guide portion **30*a* is formed at one side portion of the male connector housing 30**.

With reference to FIGS. 1 and 2, the structure of the two male and female housings 30 and 10 will be described in further detail hereinbelow. In the female housing 10, an engage projection portion **11*a* is formed at an inner upper surface of the first housing 11. A locking claw portion 15*b* is formed at an pivotal end of the pivotal locking arm 15. An engage projection 12*b* is formed near an end of the second housing 12 at the middle height thereof. A flexible terminal stopper 12a is formed at the inner bottom surface of the first housing 11**.

In the male housing 30, a deformable engage beam block portion 33*b* is formed at the middle portion of the engage beam 33. An arm locking bridge portion 33*c* is formed on top of the upper housing 32. A terminal stopper 31*a* is formed at a middle wall of the lower housing 31. Further, the above arm locking bridge portion 33*c* serves as a release button, when depressed, to release the engage beam 33 from the engage projection portion 11*a* of the female connector housing 10. Although this arm locking bridge portion 33*c* is provided on the engage beam 33, it is of course possible to provide this portion 33*c* somewhere at outer surfaces of the connector housing 30 at such a position that the pivotable locking arm 15 can be locked.

Figure 3:
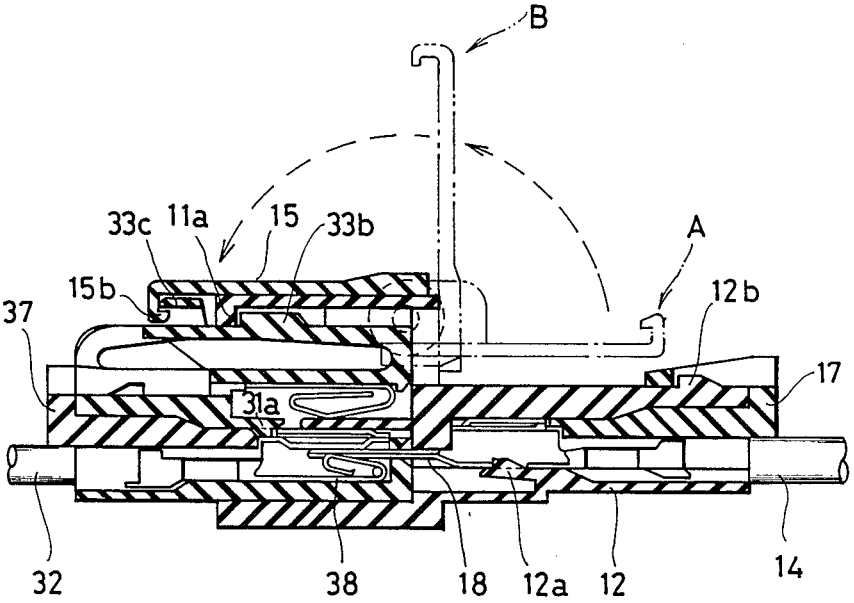
FIG. 3 is a cross-sectional view showing an engaged and locked connector according to the present invention.

In the above-mentioned construction, when the male connector housing 30 is inserted into the cavity 11*c* of the first housing 11 of the female connector housing 10 by fitting the guide portion 30*a* of the male connector housing 30 to the guide groove 11*b* formed in the female connector housing 10, an end surface 33*a* of the engage beam 33 is brought into contact with an inner end 15*c* of the pivotal locking arm 15, so that the pivotal locking arm 15 is pivoted counterclockwise from a position A toward a position B as shown in FIG. 3. In this case, the engage beam 33 is also elastically deformed because the engage projection portion 11*a* of the first housing 11 pushes the engage beam 33 inward of the male connector housing 30, so that the male connector housing 30 is engaged with the female connector housing 10 with the engage projection portion 11*a* of the female connector housing 10 engaged with the deformable engage beam block portion 33*b* of the engage beam 33 of the male connector housing 30.

As already described, under these conditions, the pivotable locking arm 15 is pivoted as shown by dot-dot-dashed lines B in FIG. 3. By observing the pivotal position of the pivotal locking arm 15 relative to the two engaged connector housings 10 and 30, the worker can visually check whether the two connector housings are firmly engaged with each other or the engage projection portion 11*a* of the female connector housing 10 is engaged with the deformable engage beam block portion 33*b* of the engage beam 33 of the male connector housing 30.

After having checked the position of the pivotal locking arm 15, the worker moves the pivotal locking arm 15 further counterclockwise until the locking claw portion 15*b* of the locking arm 15 is engaged with the arm locking bridge portion 33*c*, so that the two connector housings can firmly be locked as depicted in FIG. 3.

Further, in FIG. 3, the numeral 17 denotes an auxiliary male terminal fixing member which can support a male wire connecting terminal 18 connected to a wire of the cable 14, when the member 17 is engaged with the engage projection 12*b* of the female connector housing 10. Further, when the male wire connecting terminal 18 is housed within the second housing 12 of the housing 11, the flexible terminal stopper 12*a* is fitted to a hole or cutout formed in the male wire connecting terminal 18.

On the other hand, the numeral 37 denotes an auxiliary female terminal fixing member which can support a female wire connecting terminal 38 connected to a wire of the cable 32. Further, when the female wire connecting terminal 38 is housed within the lower housing 31 of the connector housing 30, the terminal stopper 31*a* is engaged with a stepped portion of the female wire connecting terminal 38.

As described above, in the connector according to the present invention, when the two connector housings are engaged with each other (when the engage projection portion 11*a* is engaged with the deformable engage beam block portion 33*b*), since the pivotable locking arm 15 is pivoted upward, the worker can check the engagement condition of the two connector housings. In addition, the worker can lock the two engaged connector housings, without fail, by moving the pivotable locking arm 15 further counterclockwise. In other words, the pivotal position of the locking arm can suggest that the worker must lock the two connector housings by use of the pivotable locking arm. Further, the worker can confirm the engagement and locking conditions of the connector housing on the basis of the pivotal position of the pivotable locking arm by visual inspection, thus permitting a connector to be locked further reliably.

What is claimed is:

1. A connector comprising:

(a) a first connector housing for housing at least one first wire connecting terminal, said first connector housing being formed with an engage block portion and an arm locking portion; and (b) a second connector housing for housing at least one second wire connecting terminal matable with the first wiring connecting terminal when said first and second connector housings are connected to each other, said second connector housing being formed with an engage portion engaged with the engage block portion of said first connector housing and a pivotable locking arm member partially pivoted in one pivotal direction by an end of said first connector housing to indicate engagement of said first and second connector housing when said engage block portion of said first connector housing is engaged with said second connector housing, and locked to the arm locking portion of said first connector housing when said pivotable locking arm member is further pivoted along said one pivotal direction for connector locking operation.

2. A connector comprising:

(a) a male connector housing including:

(1) a first terminal housing for housing a first wire connecting terminal;

(2) a deformable engage beam block portion; and (3) an arm locking bridge portion; and (b) a female connector housing including:

(1) a cavity for housing said male connector housing;

(2) a second terminal housing for housing a second wire connecting terminal mated with said first wire connecting terminal when said male and female connector housings are connected to each other;

(3) an engage projection portion engaged with the deformable engage beam block portion of said male connector housing; and (4) a pivotal locking arm member partially pivotable in one pivotal direction by an end of said male connector housing to indicate engagement of said male and female connector housings when said engage block portion of said male connector housing is engaged with said engage portion of said female connector housing, said pivotable locking arm member being further locked to the arm locking bridge portion when said pivotable locking arm member is further pivoted along said one pivotal direction for connector locking operation.

3. A connector having a first housing formed with a first wire connector terminal housing, a deformable engage beam block portion and an arm locking bridge portion, and a second housing formed with a second wire connector terminal housing and an engage projection portion engaged with the deformable engage beam block portion when said first and second connector housings are connected to each other for wire connection, wherein said second housing is provided with a pivotal locking member partially pivotable in one pivotal direction when said first and second housings are engaged and further locked to the arm locking bridge portion when said pivotal locking member is further pivoted along said one pivotal direction for connector locking operation to allow a worker to confirm both engagement and locking conditions of the first and second housings on the basis of two pivotal positions of said pivotal locking member.

* * * * *